United States Patent [19]

Schuster et al.

[11] Patent Number: 4,987,003

[45] Date of Patent: Jan. 22, 1991

[54] PRODUCTION OF ALUMINUM MATRIX COMPOSITE COATINGS ON METAL STRUCTURES

[75] Inventors: David M. Schuster, Lajolla, Calif.; Harvey Fisher, Lexington, Mass.; Pierre Cinq-Mars, Toronto, Canada; Bernard Altshuller, Kingston, Canada

[73] Assignee: Alcan International Limited, Montreal, Canada

[21] Appl. No.: 288,789

[22] Filed: Dec. 22, 1988

Related U.S. Application Data

[63] Continuation-in-part of Ser. No. 164,234, Mar. 4, 1988, abandoned.

[51] Int. Cl.[5] ..... B05D 3/06

[52] U.S. Cl. ..... 427/37; 427/422; 427/423; 427/427

[58] Field of Search ..... 427/37, 422, 423, 427

[56] References Cited

U.S. PATENT DOCUMENTS

| | | | |
|---|---|---|---|
| 1,128,175 | 2/1915 | Morf | 427/423 |
| 1,654,509 | 12/1927 | Claus | 427/423 |
| 3,254,970 | 6/1966 | Dittrich et al. | 427/423 |
| 3,419,415 | 12/1968 | Dittrich et al. | 427/423 |
| 3,436,248 | 4/1968 | Dittrich et al. | 427/423 |
| 4,019,875 | 4/1977 | Dittrich et al. | 427/423 |

*Primary Examiner*—Stanley Silverman
*Attorney, Agent, or Firm*—Cooper & Dunham

[57] ABSTRACT

A method is described for producing a corrosion and mechanical wear resistant coating on a metal surface to be protected. The method comprises (a) providing a rod or wire formed of a metal matrix composite comprising a metal matrix having distributed therein a finely divided solid filler material and (b) applying a coating of said metal matrix composite on said metal surface to be protected by means of a flame spraying or arc spraying process. This results in a coating of improved adhesion and low porosity.

11 Claims, 2 Drawing Sheets

PRODUCTION OF ALUMINUM MATRIX COMPOSITE COATINGS ON METAL STRUCTURES

BACKGROUND OF THE INVENTION

This invention relates to the application of corrosion and mechanical wear resistant coatings to metal surfaces and, more particularly, to the coating of steel structures with aluminum matrix composite coatings. This is a continuation-in-part of U.S. application Ser. No. 164,234, filed Mar. 4, 1988.

It is known to provide aluminum coatings on steel structures to provide protection against corrosion and mechanical wear. Such coatings are used in all environments where marine, industrial or urban corrosion are linked with mechanical wear. Such coatings are typically applied by a thermal spraying process and zinc and pure aluminum wires have been used for this purpose, particularly in marine environments where aluminum shows high resistance to salt water. This process remains in use today.

While pure aluminum provides some cathodic protection, it is mainly a barrier coating having relatively low strength and wear resistance. To solve this problem, aluminum matrix composite compositions have been used as coatings on steel substrates to give not only high cathodic protection but also good wear resistance to the steel structure. These coatings have in the past been applied by techniques such as flame spraying a body of molten metal onto the substrate to be coated, with particulate refractory or ceramic particles introduced into the spray. Flame spraying of metal powder together with refractory or ceramic particles has also been used. It is also known to use or plasma spraying in place of the above mentioned flame spraying technique.

The above techniques are very difficult to control in commercial operation and it is most difficult to obtain a uniform distribution of the refractory or ceramic particles throughout the coating. In particular, problems have been encountered with poor adhesion, high coating porosity and generally an unsound coating structure.

It is the object of the present invention to provide a method for application of aluminum matrix composite coatings of improved quality on metal structures.

SUMMARY OF THE INVENTION

According to the present invention an aluminum matrix composite coating is applied to metal substrates by directly flame spraying or arc spraying a preformed aluminum matrix composite material. The preformed material is preferably in the form of a wire or rod which acts as a feedstock for the flame spraying or arc spraying process.

Metal matrix composites are well known in the art and are formed of a metal matrix having distributed therein a divided solid filler, i.e. a fibrous or particulate material which is capable of being incorporated in and distributed through the metal matrix and which at least substantially maintains its integrity as incorporated rather than losing its form or identity by dissolution in or chemical combination with the metal.

It is known that the strength of aluminum and aluminum alloy articles can be significantly enhanced by incorporation of fibrous or particulate solid fillers in the form of short, discontinuous, more or less randomly oriented particles. For many applications it is known to distribute the fibers substantially uniformly throughout the metal article.

As examples of solid filler materials that have been used for the above purpose, there may be mentioned alumina, titanium diboride, silica, zirconia, silicon carbide, silicon nitride, etc. Aluminum-$TiB_2$ composites, for instance, have been used for applications requiring high strength and/or high resistance to wear.

The aluminum matrix composite materials utilized as feedstocks in the process of this invention are manufactured by techniques known in the art and typically contain 5 to 60 volume % of the refractory or ceramic filler. A range of 5 to 40 volume % of filler is preferred, with a range of 10 to 20 volume % being particularly preferred. The coating is preferably applied to a thickness in the range of about 50 to 5000 microns.

The substrate to be treated is typically a ferrous metal, e.g. steel, structure. Other substrates that may be coated according to the invention include a heat treatable, high strength aluminum alloy structure, e.g. an AA 7000 series alloy. Such aluminum alloys are sometimes subject to stress corrosion in service.

The surface of the substrate to be treated is preferably prepared by grit blasting, e.g. using alumina particles. It has also been found to be advantageous, but not essential, to preheat the substrate to at least about 120[C to remove surface moisture prior to application of the coating. Of course, this is not always feasible, particularly for marine applications. In some instances, it may also be advantageous to precoat the substrate by conventional metallizing with aluminium prior to the application of the aluminum matrix composite coating.

It has surprisingly been found that the composite coating formed by the method of this invention are generally superior to those obtained by the prior methods. In particular, the composite coatings obtained by the present invention have improved adhesion, low porosity and generally a sound structure.

The following specific examples illustrate certain preferred features of the present invention.

EXAMPLE 1

A cast ingot was formed comprising an AA 1350 aluminum containing about 15 volume % of silicon carbide particles uniformly distributed throughout. The ingot was made according to the method disclosed in PCT application WO87/06624, published Nov. 5, 1987, the content of which is incorporated herein by reference. The ingot was extruded and drawn into a wire having a diameter of about 2.3 mm and this became the feedstock for an arc spray process.

A steel substrate was used in the form of a steel cylinder and an arc was struck between a pair of feed wires formed of the above aluminum matrix composite material. The arc was held at a distance of approximately 4" from the cylinder while the cylinder was rotated, with an arc current of approximately 150 amps being used. A coating having a thickness of approximately 3000 microns was deposited on the cylinder.

The product obtained was subjected to metallographic examination and the coating had good adhesion, a low porosity and a generally sound structure.

EXAMPLE 2

Tests were conducted to compare a composite coating produced by the method of this invention with a composite coating produced by a prior art method.

A. Inventive method

Following the same general procedure as in Example 1, a cast ingot was obtained containing about 10 volume % of silicon carbide particles uniformly distributed in an AA 6061 aluminum alloy.

The ingot was extruded and drawn into a wire having a diameter of about 2.3 mm and this was used as a feedstock for an arc spray process.

A steel substrate in the form of a flat bar was used and an arc was struck between a pair of feed wires formed of the above ingot. The arc was held at a distance of about 4" from the steel bar with an arc current of about 150 amps being used. A coating having a thickness of about 3000 microns was deposited on the bar.

Figure 2:
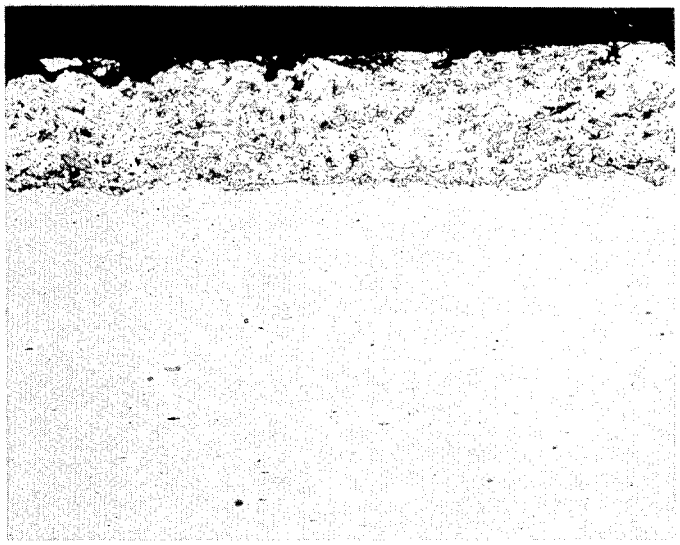
FIG. 2 is a photomicrograph showing a coating according to this invention.

The product was subjected to metallographic examination and the results obtained are shown in FIG. 2.

B. Prior Art Method

An AA 6061 aluminum alloy was formed into a wire having a diameter of about 2.3 mm and this was used as a feedstock for an arc spray process.

A steel substrate in the form of a flat bar was used and an arc was struck between a pair of feed wires formed of the above alloy. The arc was held at a distance of about 4" from the steel bar with an arc current of about 150 amps being used. Simultaneously, silicon carbide particles were fed between the arcing wires to be deposited with the aluminum, the silicon carbide particles being fed at a rate of about 10 volume % relative to the aluminum alloy fed. A composite coating having a thickness of about 5000 microns was deposited on the bar.

Figure 1:
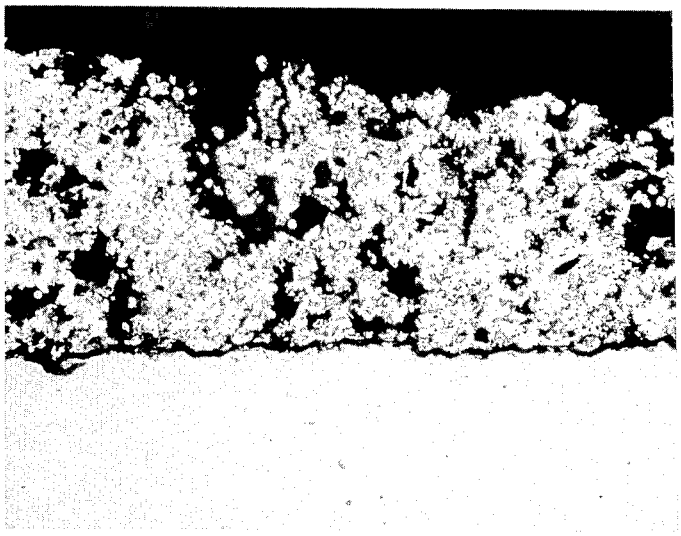
FIG. 1 PRIOR ART
FIG. 1 is a photomicrograph showing a prior art coating.

The product was subjected to metallographic examination and the results obtained are shown in FIG. 1.

Comparing FIG. 2 with FIG. 1, it is readily evident that the process of this invention produces a much more uniform coating with fewer voids (shown as black areas) than does the coating produced by the prior art process.

EXAMPLE 3

Following the same general procedure as in Example 1, a cast ingot was formed comprising an AA-1060 aluminum containing about 15 volume % of aluminum oxides particles uniformly distributed throughout. The ingot was extruded and drawn into wires having diameters of 3.2 and 2.4 mm and this became the feedstock for a flame spray process.

Prior to flame spraying, flat steel sheet was solvent degreased and then grit blasted with No. 16 alumina. A 3 to 3.2 thousandth of an inch anchor tooth pattern was obtained on the steel.

The steel samples were flame sprayed within 10 minutes after grit blasting with either 3.2 or 2.4 mm composite wire.

The flame spray system was operated at an oxygen gas setting of 35 psi at 50 cfh, an acetylene gas setting of 20 psi at 40 cfh and an air setting of 65 psi at 56 cfh. The spray gun was held at a distance of approximately 6 inches from the steel samples.

Figure 3:
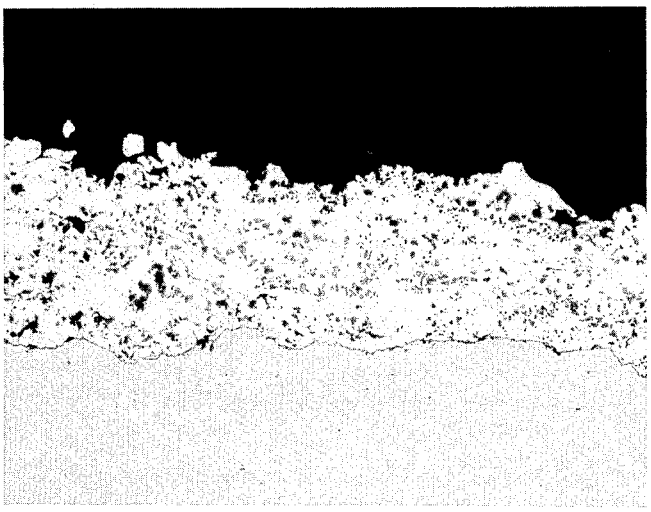
FIG. 3 is a photomicrograph of a further coating according to this invention.
Figure 4:
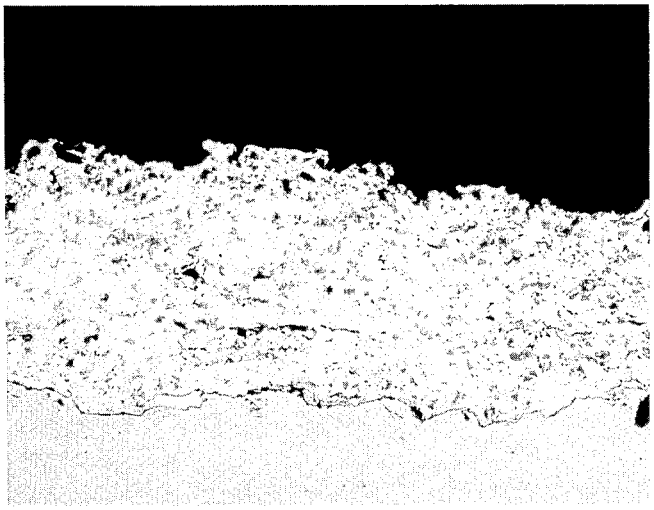
FIG. 4 is a photomicrograph of a still further coating according to this invention.

The coated samples were subjected to metallographic examination and the results obtained are shown in FIGS. 3 and 4, FIG. 3 being with the 2.4 mm wire and FIG. 4 being with the 3.2 mm wire. Both photomicrographs show uniform coatings with very few voids.

We claim:

1. A method of producing a corrosion and mechanical wear resistant coating on a metal surface to be protected which comprises (a) providing a rod or wire formed of a metal matrix composite comprising a metal matrix having distributed therein a finely divided solid filler material and (b) applying a coating of said metal matrix composite on said metal surface to be protected by means of a flame spraying or arc spraying process.

2. A method according to claim 1 wherein the metal matrix composite is an aluminum matrix containing fibrous or particulate refractory filler material.

3. A method according to claim 2 wherein the matrix contains 5 to 60 volume percent of filler.

4. A method according to claim 2 wherein the matrix contains 5 to 40 volume percent of filler.

5. A method according to claim 2 wherein the matrix contains 10 to 20 volume percent of filler.

6. A method according to claim 2 wherein the metal surface is the surface of a ferrous metal structure.

7. A method according to claim 2 wherein the metal surface is the surface of a heat treatable, high strength aluminum alloy structure.

8. A method according to claim 6 wherein the filler material is selected from alumina, titanium diboride, silica, zirconia, silicon carbide and silicon nitride.

9. A method according to claim 6 wherein the filler material is alumina.

10. A method according to claim 8 wherein the aluminum matrix is unalloyed aluminum.

11. A method according to claim 8 wherein the protective coating is applied to a thickness of about 50 to 5000 microns.

* * * * *